US005560610A

United States Patent [19]

Behm et al.

[11] Patent Number: 5,560,610

[45] Date of Patent: Oct. 1, 1996

[54] INSTANT BINGO GAME CARD

[75] Inventors: William F. Behm, Marietta; Mark C. Tevis, Cumming, both of Ga.

[73] Assignee: Scientific Games Inc., Alpharetta, Ga.

[21] Appl. No.: 578,387

[22] Filed: Dec. 26, 1995

Related U.S. Application Data

[63] Continuation of Ser. No. 430,714, Apr. 27, 1995, abandoned, which is a continuation of Ser. No. 264,798, Jun. 23, 1994, abandoned, which is a division of Ser. No. 51,912, Apr. 22, 1993, abandoned.

[51] Int. Cl.[6] ..... A63F 3/06

[52] U.S. Cl. ..... 273/269; 273/139

[58] Field of Search ..... 273/269, 139; 283/72, 73, 74, 94, 95, 96, 97, 98, 109, 114, 903

[56] References Cited

U.S. PATENT DOCUMENTS

| | | | |
|---|---|---|---|
| 4,466,614 | 8/1984 | Bachman et al. . | |
| 4,491,319 | 1/1985 | Nelson . | |
| 4,775,155 | 10/1988 | Lees | 273/139 |
| 5,074,566 | 12/1991 | Desbiens | 273/139 X |
| 5,083,815 | 1/1992 | Scrygeour et al. | 283/72 |
| 5,092,598 | 3/1992 | Kamille | 273/139 |
| 5,100,139 | 3/1992 | Di Bella | 273/139 X |
| 5,118,109 | 6/1992 | Gumina | 273/139 |
| 5,158,293 | 10/1992 | Mullins | 273/139 |
| 5,193,815 | 3/1993 | Pollard | 273/269 |

FOREIGN PATENT DOCUMENTS

| | | | |
|---|---|---|---|
| 0048961 | 4/1982 | European Pat. Off. | 273/139 |
| 2136374 | 12/1972 | France . | |
| 2024022 | 1/1980 | United Kingdom . | |

*Primary Examiner*—William E. Stoll

*Attorney, Agent, or Firm*—Michael B. McMurry; Kathleen A. Ryan

[57] ABSTRACT

The playability of an instant bingo game card or similar type game cards can be enhanced by providing for improved marking of numbers on a player card portion of the bingo card. In one approach, a space is provided along side each number in which a mark is printed and a scratch-off coating is applied over the mark. In a second approach, a microencapsulated pressure sensitive dye is applied over each number and by simply rubbing a particular number can be marked.

5 Claims, 2 Drawing Sheets

INSTANT BINGO GAME CARD

This is a continuation of Ser. No. 08/430,714, filed Apr. 27, 1995, now abandoned, which is a continuation of Ser. No. 08/264,798 filed Jun. 23, 1994, now abandoned, which is a divisional of Ser. No. 08/051,912, filed Apr. 22, 1993, now abandoned.

TECHNICAL FIELD

The invention relates to the field of instant lottery tickets and in particular to instant bingo game cards.

BACKGROUND OF THE INVENTION

The purpose of an instant bingo card or ticket is to simulate the play of a conventional bingo game utilizing instant lottery technology. An instant bingo card will normally include a caller card portion which has a number of combinations of letters and numbers covered by a latex or scratch-off coating. The letter-number combinations on the caller's card correspond to the letter-number combinations found on the balls that are typically drawn in a conventional bingo game. There are normally twenty five letter-number combination printed under the scratch-off coating. Also printed on an instant bingo card is a group of usually four to six player cards which are similar in format to bingo cards used by players in conventional bingo games. To play the game, a player will scratch off the coating over the letter-number combinations on the caller's card and mark on each of the player cards any numbers that may correspond to letter-number combinations on the caller's card. Usually printed on the instant bingo card adjacent to the player cards is an indication of the combinations that will result in the awarding of a prize. After marking the player cards, the player is able to determine if one or more of the player cards represent a winning combination and if a winning combination is present, the player can then present the card to a lottery agent to redeem the indicated prize(s).

One of the challenges of producing a commercially satisfactory instant lottery card is to provide a method for marking the player cards which is convenient to use yet economical to manufacture. In one approach the numbers on the player cards are covered by a scratch-off coating and numbers corresponding directly to the numbers printed on the player card are printed, utilizing for example a technique disclosed in U.S. Pat. No. 5,074,566, on the scratch-off coating. The player is, then able to mark his cards by scratching off the numbers on his player card corresponding to the letter-number combinations on the caller card portion of the instant bingo card. This approach has two disadvantage in that it requires a second scratch-off area and more importantly requires two separate printings of the numbers on the player cards. These factors substantially increase the manufacturing cost of the card. The second scratch-off area also results in a great deal more scratch-off debris following the play of the game.

A second technique, as disclosed in U.S. Pat. No. 5,193,815, is to print a translucent coat of a scratchable material over the player cards which is pigmented so as to modify the appearance of the color of the area under the translucent coat. By scratching off the translucent coat over a particular number on the player cards, the player can mark this number by the resulting apparent color change. This approach has three disadvantages. First, when effecting the color change the player's card area always changes from a darker color to a lighter color. This is the opposite of how a player marks his card in an actual bingo game. Second, the color(s) of the player's cards before rubbing (marking) are always created colors. The created color(s) are the combination of the color of the underlying layer on which the player's numbers are printed and the color of the translucent tinted layer. Colors created in this fashion are limited by the tint of the scratch-off translucent layer. The color of the translucent layer is limited in that it must be of sufficient contrast to result in easily discernible marks of the player's card when removed but not so dark as to make reading of the player's number difficult prior to removal. Finally, the scratch-off layer over the player's cards results in more scratch-off debris following play of the game.

SUMMARY OF THE INVENTION

It is therefore an object of the invention to provide an instant bingo card having player cards with a method of marking numbers on the player cards that result in high contrast with a minimum in production costs and less scratch-off debris following play of the game.

Another object of the invention is to provide an instant bingo card having player cards with a relatively small marked space located adjacent to each number on the player cards covered with a scratch-off coating. To mark a number the player scratches off the coating adjacent to the number revealing an indicator symbol such as a red "x".

Another object of the invention is to provide an instant bingo card having player cards where numbers on the player cards can be marked by simply applying pressure to the numbers to he marked. To accomplish this objective, a color former and an activator ire applied to the player card area. By microencapsulating either the color former or the activator, color change is inhibited until pressure is applied by the player to the number to be marked. In one embodiment of the invention, the color former is applied over the numbers printed on the card substrate and the activator or color developer is laid down in microencapsulated form over the color former.

DETAILED DESCRIPTION OF THE INVENTION

Figure 1:
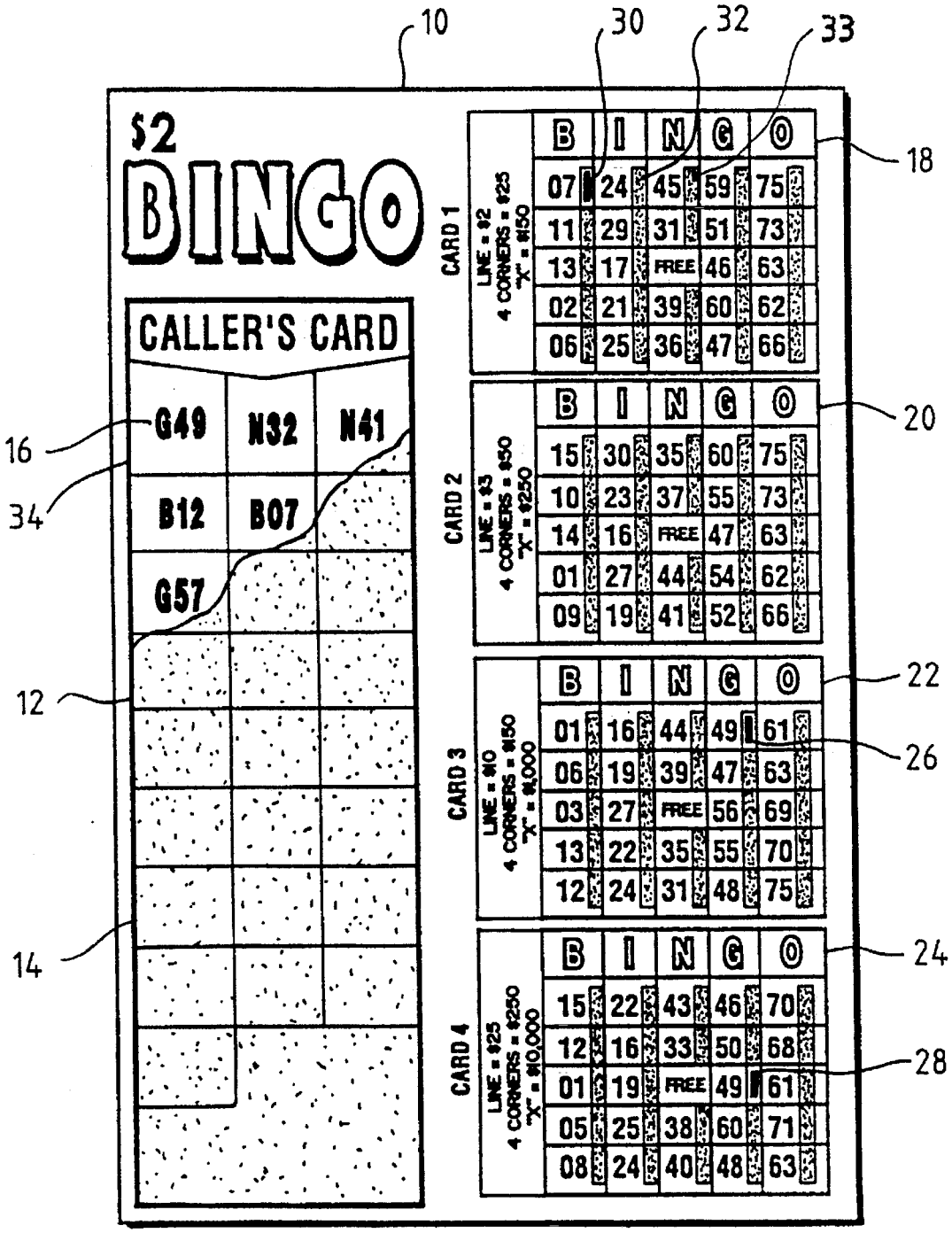
FIG. 1 is a plan view of an instant bingo card having a set of player cards which include a space containing a mark covered by a scratch-off coating located adjacent to each number printed on the card.

FIG. 1 shows a top view of an instant bingo game card 10 employing a first embodiment of the invention. Located on the left side of the card 10 is a caller's card 12 illustrated in broken away form with the lower portion showing a latex scratch-off material 14 an the upper portion showing a set of letter number combinations represented generally at 16 that are printed on the card 10 underneath the scratch-off coating 14. It is the letter-numbers 16 that are equivalent to the letter-numbers that appear on balls drawn in a convention bingo game. Arrayed on the right hand side of the card 10 is a group of four players cards 18–24 each of which includes a column of five numbers located below each of the letters BINGO. Along side each of the numbers printed on the players cards 18–24 is a space containing a mark as shown by the representative examples 26, 28 and 30. Each of the marks represented at 26–30 is covered by a scratch-off material of the same type used for the scratch-off material used on the caller's card 12 as shown for example at 32 and 33. During manufacture of the card 10, the latex covers, represented at 26–30 placed over the marks on the players cards 18–24, are applied in the same process step as the covering 14 on the caller's card 12.

The marks as shown at 26–30 facilitate the playing of the bingo game on the card 10 by making it possible for the player to mark the letter-number combinations 16 that appear on the caller's card 12 on each of the players cards 18–24. For example, the letter-number combination G49 that is printed a location 34 on the caller's card 12 can readily be marked on the players cards 22 and 24 by simply removing the scratch-off coating covering these marks 26 and 28 which are adjacent to the numbers 49 printed on the players cards 22 and 24. Visual perception of the marks 26–30 can be enhanced by selecting a color for the marks such as 22 and 24 that provides for maximum contrast between the marks and the background material on the players cards 18–24 upon which the numbers are printed. For example, red can be used for the marks 26–30 where the background material on the players cards 18–24 is yellow, white, light blue and light green, respectively. Thus this embodiment of the invention permits the selection of a wide variety colors for the players cards 18–24 so that the cards 10 can be designed for maximum player appeal while at the same time promoting ease of use by the players.

Figure 2:
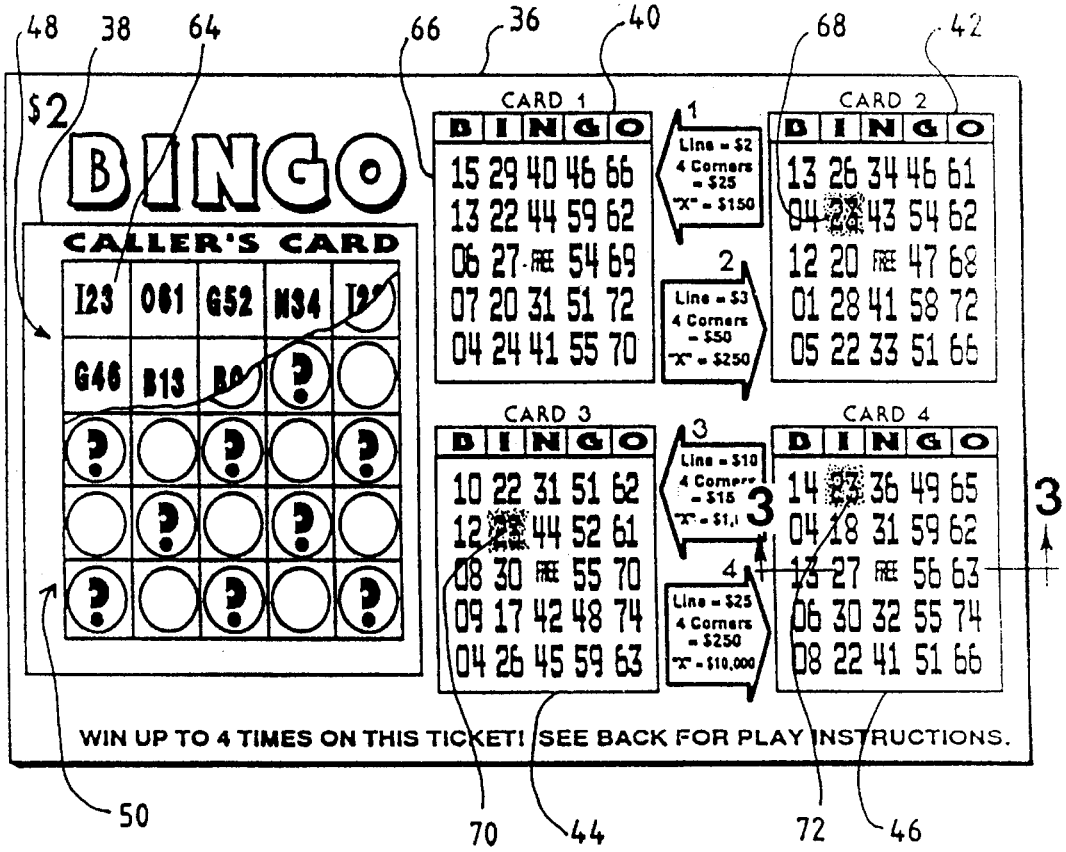
FIG. 2 is a plan view of an instant bingo card having a set of player cards with a color former and an activator applied thereto.
Figure 3:
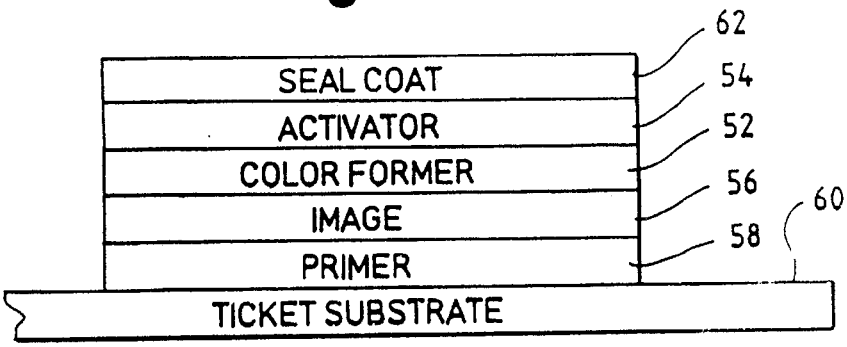
FIG. 3 is a partial cross sectioned view along lines 3—3 of FIG. 2.

A second embodiment of the invention is illustrated in FIGS. 2 and 3. A top view of an instant bingo game card 36 having a caller's card portion 38 and a set of four players cards 40–46 is shown in FIG. 2. As with the card 10 of FIG. 1, the caller's card 38 has a group of letter-number combinations or indicia indicated at 48 printed below a scratch-off latex covering indicated at 50 and the players cards 40–46 contain a column of five numbers aligned below each of the letters BINGO. In this embodiment of the invention the marking of the numbers in the players cards 40–46 is provided for by applying a color former 52 and an activator 54 over a number image 56 printed on a primer surface 58 that is applied to a card substrate 60 as shown in FIG. 3. A seal coat 62 is applied over the activator. The numbers on the players cards 40–46 are marked by pressing on the particular number to be marked which has the effect of combining the color former 52 with the activator or developer 54 to produce a visible color change on the number. A dye or equivalent substance is included in the color former 52 that is sufficiently different in color from the color of the back ground on the substrate 60 to result in a readily perceivable mark. For example, the player would mark the letter-number combination 123 which appears at 64 on the caller's card 38 by pressing on a corresponding number 68–72 on one of the players cards 40–40. The shaded portion of the player's cards 42–46 covering the numbers 68–72 is used to represent in FIG. 2 the visual effect of the dye. To prevent premature mixing, either the activator 54 or the color former 52 are microencapsulated.

In the preferred embodiment, the color former 52 has the following composition by weight: an aqueous dispersion of a microencapsulated blue leuco dye where the microspheres are 4–10 microns, 46.5%; an acrylic copolymer, 8%; water, 12.9% isopropyl alcohol, 15%; a non-ionic surfactant, 1% modified dimethyl polysiloxane, 0.5%; large granule wheat starch having a particle size of 16–32 microns, 7.5%; water, 5%; ammonium hydroxide, 0.3% and water 3.3%.

The preferred activator 54 formulation has the following composition by weight: normal propyl acetate, 27.44%; ethyl alcohol, 7.2%; phenolic resin, 24.46%; acrylic resin, 15.%; ss nitrocellulose (30% dry), 8.5%; ethyl alcohol, 5%; and ethyl acetate, 12.5%.

The above formulations including a water based color former lacquer 52 and solvent based activator 54 represent the preferred compositions, however, it will be understood that the activator 54 could also be a water based system and the color former 52 could be solvent based. Also the activator 54 can be microencapsulated. As can be appreciated, the object of microencapsulating one or the other is to separate the color former 52 from the activator 54 until pressure is applied by a player to the number on one of the player cards 40–46 that he desires to mark.

Another important feature of the invention is that the color former 52 and the actuator 54, as described above, can form a clear layer over the number or image 56 on the player's cards 40–46. In this manner, maximum contrast can be provided for between the marked and unmarked numbers on the player's cards 40–46. Also, it is possible to print a developable symbol such as an "x" in register over each of the numbers on the player's cards 40–46 using the actuator 54 and color form 52. Rubbing the number would then produce the symbol as a mark for the number.

We claim:

1. A game card comprising:

a substrate;

a plurality of play indicia printed on a first location on said substrate;

a first opaque scratch-off coating applied over said play indicia to permit a player to select said play indicia by removing portions of said first opaque scratch-off coating covering said selected play indicia;

a plurality of marks printed on a second location on said substrate spaced apart from said first location wherein said marks include a first portion covered by a second opaque scratch-off coating and a second portion having marking indicia not covered by said second opaque scratch-off coating and wherein one of said marking indicia uniquely represents each of said play indicia such that removal of said second opaque scratch-off coating from one of said marks by the player will serve to mark the corresponding player indica represented by the marking indicia of said one of said marks.

2. The game card of claim 1 wherein said second scratch-off coating is made of the same material as said first scratch-off coating.

3. The game card of claim 1 wherein said play indicia and said marking indica are a letter-number combinations.

4. The game card of claim 3 wherein said first location is configured as a bingo caller's card with said play indicia printed as an array of said letter-number combinations and said second area is configured as a plurality of player cards with said marks printed in arrays in said player cards.

5. The game card of claim 4 wherein said second scratch-off coating is made of the same material as said first scratch-off coating.

* * * * *